US012343592B2

(12) United States Patent
Lucas

(10) Patent No.: US 12,343,592 B2
(45) Date of Patent: Jul. 1, 2025

(54) EXERCISE SYSTEM FOR ENABLING LATERAL TILTING OF A STATIONARY BICYCLE

(71) Applicant: Beth Ann Lucas, Avon, IN (US)

(72) Inventor: Beth Ann Lucas, Avon, IN (US)

( * ) Notice: Subject to any disclaimer, the term of this patent is extended or adjusted under 35 U.S.C. 154(b) by 178 days.

(21) Appl. No.: 17/807,897

(22) Filed: Jun. 21, 2022

(65) Prior Publication Data

US 2023/0405397 A1 Dec. 21, 2023

(51) Int. Cl.
*A63B 22/06* (2006.01)
*A63B 22/00* (2006.01)

(52) U.S. Cl.
CPC ..... *A63B 22/0605* (2013.01); *A63B 22/0046* (2013.01); *A63B 2022/0641* (2013.01)

(58) Field of Classification Search
CPC ..... A63B 69/16; A63B 21/0428; A63B 21/4031; A63B 26/003; A63B 21/4033; A63B 23/0211; A63B 21/0552; A63B 21/0421; A63B 21/4035; A63B 21/0083; A63B 21/00069; A63B 21/4034; A63B 2022/0641; A63B 2023/003; A63B 2225/093; A63B 23/03525; A63B 21/0557; A63B 22/0605; A63B 22/0046
See application file for complete search history.

(56) References Cited

U.S. PATENT DOCUMENTS 4,743,012 A 5/1988 Kim
5,851,166 A * 12/1998 Bernardson ..... A63B 22/16 482/79
7,438,672 B1 * 10/2008 Rylander ..... A63B 22/0605 482/61
9,861,872 B1 * 1/2018 Hsiung ..... A63B 22/0046
10,071,298 B1 * 9/2018 McCormack ..... A63B 69/16
(Continued)

FOREIGN PATENT DOCUMENTS

EP 0925809 A1 6/1999
JP 2014151070 A 8/2014
(Continued)

OTHER PUBLICATIONS

Strider, Rocking Base for Balance Bikes, Amazon.com listing, https://www.amazon.com/Strider-Rocking-Balance-Bikes-Months/dp/B01N1G0HG4, available on or before Feb. 11, 2022 (9 pages).
(Continued)

*Primary Examiner* — Megan Anderson
*Assistant Examiner* — Andrew M Kobylarz
(74) *Attorney, Agent, or Firm* — Maginot, Moore & Beck

(57) ABSTRACT

A support assembly is for connection to a stationary bicycle. The stationary bicycle includes a front cross member and a rear cross member. The support assembly includes a first rocker unit, a second rocker unit, a first connecting member, and a second connecting member. The first rocker unit is configured to operably connect to the front cross member. The first rocker unit defines a first ground-engaging arch-shaped surface. The second rocker unit is configured to
(Continued)

operably connect to the rear cross member. The second rocker unit defines a second ground-engaging arch-shaped surface. The first connecting member extends from the first rocker unit to the second rocker unit. The second connecting member extends from the first rocker unit to the second rocker unit.

17 Claims, 14 Drawing Sheets

(56) References Cited

U.S. PATENT DOCUMENTS

| | | | | |
|---|---|---|---|---|
| 10,702,739 | B1 * | 7/2020 | McCormack | A63B 21/0428 |
| 10,974,118 | B2 * | 4/2021 | Bass | A63B 22/0605 |
| 2009/0186746 | A1 * | 7/2009 | Pandolfo | A63B 71/023 482/7 |
| 2010/0288901 | A1 * | 11/2010 | Wallach | A63B 22/0076 248/346.03 |
| 2016/0287931 | A1 * | 10/2016 | Tung | A63B 22/16 |
| 2020/0215381 | A1 | 7/2020 | Bass et al. | |
| 2021/0291007 | A1 | 9/2021 | Monti | |
| 2023/0338774 | A1 * | 10/2023 | Hawkins, III | A63B 24/0062 |

FOREIGN PATENT DOCUMENTS

| | | |
|---|---|---|
| WO | 2009097452 | 8/2009 |
| WO | 2016134726 | 9/2016 |
| WO | 2022109643 A1 | 6/2022 |

OTHER PUBLICATIONS

International Search Report corresponding to PCT Application No. PCT/US2023/066346, mailed Aug. 31, 2023 (3 pages).

* cited by examiner

EXERCISE SYSTEM FOR ENABLING LATERAL TILTING OF A STATIONARY BICYCLE

FIELD

This disclosure relates to the field of exercise equipment, and, in particular, to an exercise system having a stationary bicycle that tilts from side-to-side to provide a user of the exercise system with an improved workout experience.

BACKGROUND

Stationary bicycles are exercise machines that are used to increase general fitness, for weight loss, for physical therapy, and to train for cycling events. As used herein, the stationary bicycle is also referred to as a stationary bike, an exercise bicycle, an exercise bike, a spinning bicycle, and a spinning bike. Stationary bicycles typically include pedals and a handlebar in the configuration of a typical bicycle. A benefit of stationary bicycles is that during pedaling stationary bicycles remain in a fixed location so that the user can operate the stationary bicycle indoors, for example.

Stationary bicycles provide users with a high and low-impact effective cardiovascular workout that focuses on using the leg muscles. Most stationary bicycles provide the user with an option to select a desired resistance level required to rotate the pedals. In this way, the stationary bicycle can be configured to a suitable level of resistance for most users.

Unlike a traditional bicycle, the typical stationary bicycle is held in a fixed lateral position, such that the user is not required to balance the stationary bicycle during use. In particular, when riding a bicycle, in addition to using her legs, the user must engage her core muscles in order to balance the bicycle as the bicycle tilts to the left and right during pedaling and during turning. Whereas, the fixed and rigid structure of a typical stationary bicycle does not require balancing. As a result, some users may not engage their core muscles during use of a stationary bicycle. Accordingly, these users may not achieve the same level of workout as they would when riding a traditional bicycle.

Based on the above, improvements to stationary bicycles are desired in order to provide users with an even better workout experience and also to make operating the stationary bicycle feel even more similar to operating a traditional bicycle.

SUMMARY

According to an exemplary embodiment of the disclosure, a support assembly is configured for connection to a stationary bicycle. The stationary bicycle includes a front cross member and a rear cross member. The support assembly includes a first rocker unit, a second rocker unit, a first connecting member, and a second connecting member. The first rocker unit is configured to operably connect to the front cross member. The first rocker unit defines a first ground-engaging arch-shaped surface. The second rocker unit is configured to operably connect to the rear cross member. The second rocker unit defines a second ground-engaging arch-shaped surface. The first connecting member extends from the first rocker unit to the second rocker unit. The second connecting member extends from the first rocker unit to the second rocker unit.

According to another exemplary embodiment of the disclosure, a support assembly is configured for connection to a stationary bicycle. The stationary bicycle includes a front cross member and a rear cross member. The support assembly includes a first rocker unit, a second rocker unit, a first connecting member, and a second connecting member. The first rocker unit is configured to operably connect to the front cross member. The first rocker unit defines a first arch-shaped surface located between a first stop structure and a second stop structure. The second rocker unit is configured to operably connect to the rear cross member. The second rocker unit defines a second arch-shaped surface located between a third stop structure and a fourth stop structure. The first connecting member extends from the first stop structure to the third stop structure. The second connecting member extends from the second stop structure to the fourth stop structure. The support assembly is configured to tilt on the first and second arch-shaped surfaces between a position of maximum left tilt and a position of maximum right tilt. At the position of maximum left tilt, the first stop structure and the third stop structure engage the ground to prevent further left tilting. At the position of maximum right tilt, the second stop structure and the fourth stop structure engage the ground to prevent further right tilting.

According to yet another exemplary embodiment of the disclosure an exercise system includes a stationary bicycle, a first rocker unit, and a second rocker unit. The stationary bicycle includes a first connection member and an opposite second connection member. The first rocker unit includes a first ground-engaging support, a first rocker structure, and a first guide post. The first rocker structure is connected to the first connection member and defines (i) a first arch-shaped surface positioned on the first ground-engaging support, and (ii) a first guide slot extending through the first arch-shaped surface. The first guide post is mounted on the first ground-engaging support and extends through the first guide slot. The second rocker unit includes a second ground-engaging support, a second rocker structure, and a second guide post. The second rocker structure is connected to the second connection member and defines (i) a second arch-shaped surface positioned on the second ground-engaging support, and (ii) a second guide slot extending through the second arch-shaped surface. The second guide post is mounted on the second ground-engaging support and extends through the second guide slot. The stationary bicycle is configured to tilt on the first and second arch-shaped surfaces between a position of maximum left tilt and a position of maximum right tilt.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
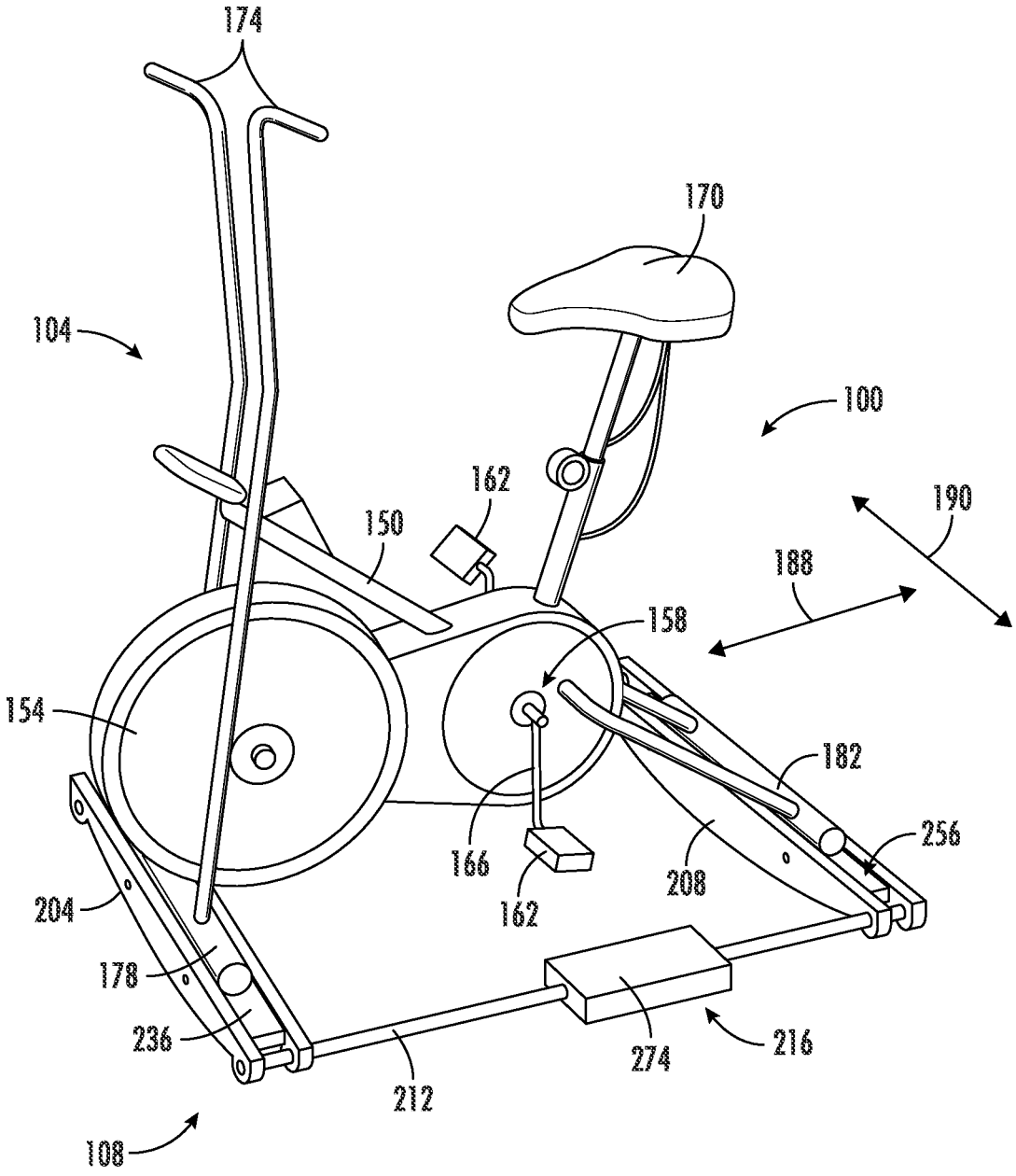
FIG. 1 shows an exercise system including a stationary bicycle and a support assembly.

For the purpose of promoting an understanding of the principles of the disclosure, reference will now be made to the embodiments illustrated in the drawings and described in the following written specification. It is understood that no limitation to the scope of the disclosure is thereby intended. It is further understood that this disclosure includes any alterations and modifications to the illustrated embodiments and includes further applications of the principles of the disclosure as would normally occur to one skilled in the art to which this disclosure pertains.

Aspects of the disclosure are disclosed in the accompanying description. Alternate embodiments of the disclosure and their equivalents may be devised without parting from the spirit or scope of the disclosure. It should be noted that any discussion herein regarding "one embodiment," "an embodiment," "an exemplary embodiment," and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

For the purposes of the disclosure, the phrase "A and/or B" means (A), (B), or (A and B). For the purposes of the disclosure, the phrase "A, B, and/or C" means (A), (B), (C), (A and B), (A and C), (B and C), or (A, B and C).

The terms "comprising," "including," "having," and the like, as used with respect to embodiments of the disclosure, are synonymous.

As shown in FIG. 1, an exercise system 100 includes a stationary bicycle 104 and a support assembly 108. When the stationary bicycle 104 is mounted on the support assembly 108, the stationary bicycle 104 laterally tilts, leans, or rocks to provide the user with a simulation of the lateral tilting that occurs when riding a traditional outdoor bicycle. FIG. 1 illustrates the exercise system 100 in a neutral, un-tilted, or balanced position. Each element of the exercise system 100 is described herein.

As used herein, the stationary bicycle 104 includes all devices having pedals that can be rotated relative to a frame or body. The illustrated stationary bicycle 104 is an example only, and the term "stationary bicycle" extends to all type of stationary bicycles. The term "stationary bicycle" also includes ridable children's toys both with and without pedals.

The exemplary stationary bicycle 104 includes a frame 150, a flywheel 154, a pedal assembly 158 having pedals 162 and a crankshaft 166, a seat 170, handlebars 174, a front cross member 178, and a rear cross member 182. The frame 150 is typically formed from metal and/or another strong and rigid material or materials. The flywheel 154 is mounted on the frame 150 for rotation. The pedal assembly 158 is mounted on the frame 150 and is operably connected to the flywheel 154 to rotate the flywheel 154. Specifically, when the user applies force to the pedals 162, the crankshaft 166 rotates and results in rotation of the flywheel 154. The front and rear cross members 178, 182 extend laterally from the frame 150 and are fixed in position relative to the frame 150. The cross members 178, 182 are also referred to herein as connection members. In the illustrated embodiment, the handlebars 174 are fixed in position relative to the frame 150. In other embodiments, however, the handlebars 174 are movable toward and away from the seat 170 to provide the user with an additional upper body workout.

As shown in FIG. 1, the stationary bicycle 104 defines a longitudinal axis 188 that extends through the front and the rear of the stationary bicycle 104. The front and rear cross members 178, 182 are mounted to the frame 150 perpendicular to the longitudinal axis 188. A lateral direction 190 is perpendicular to the longitudinal axis 188. The exercise system 100 is configured to tilt in the lateral direction 190.

Figure 2:
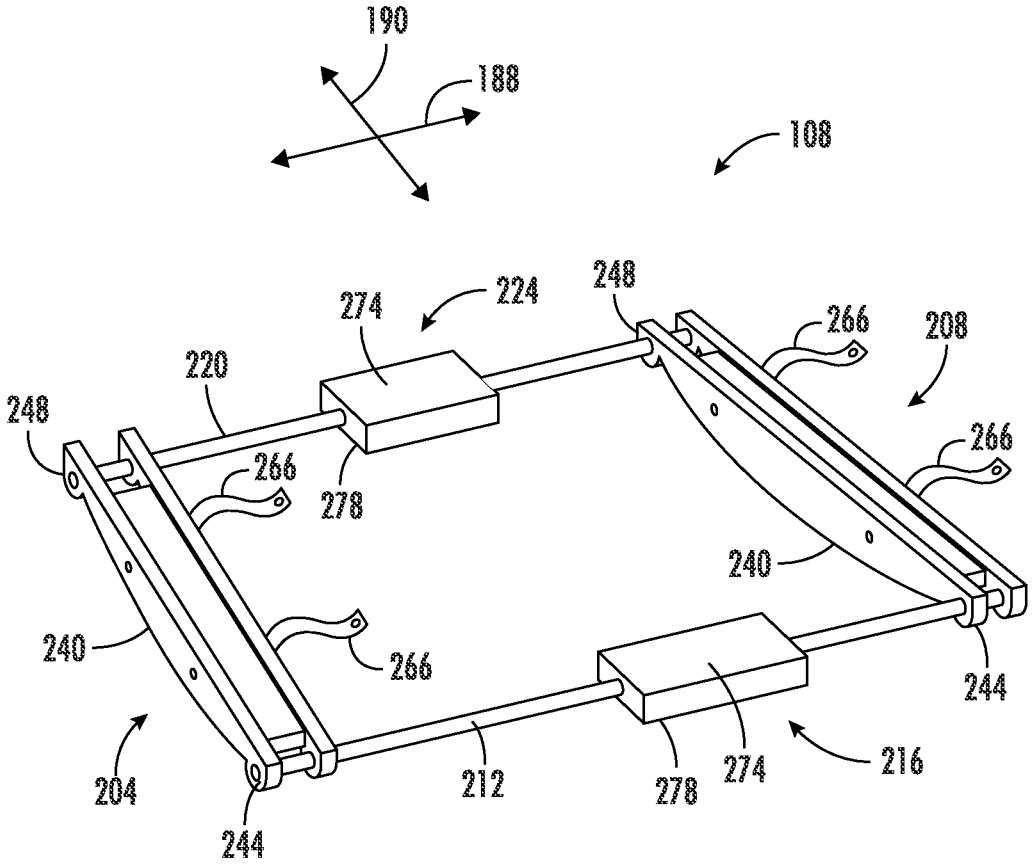
FIG. 2 shows the support assembly of FIG. 1 without the stationary bicycle.

With reference to FIG. 2, the support assembly 108 includes a front rocker unit 204, a rear rocker unit 208, a left connecting member 212 including a left stabilizing step 216, and a right connecting member 220 including a right stabilizing step 224. The connecting members 212, 220 are configured to connect the rocker units 204, 208 together. Each stabilizing step 216, 224 is mounted on a corresponding one of the connecting members 212, 220.

Figure 3:
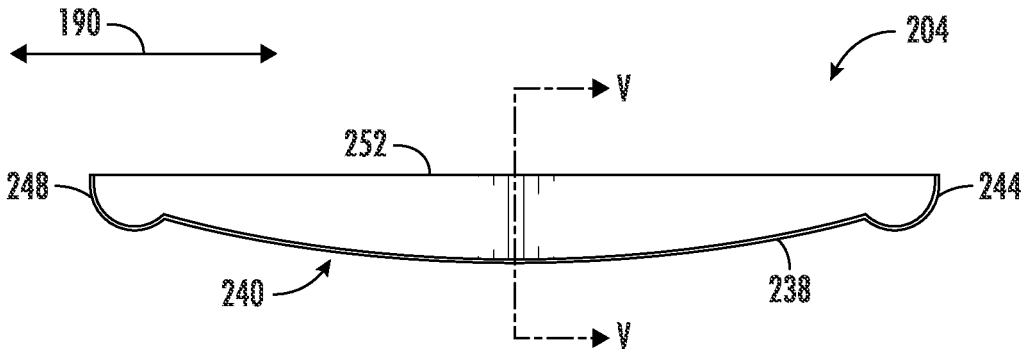
FIG. 3 shows a front rocker unit of the support assembly of FIG. 2.
Figure 4:
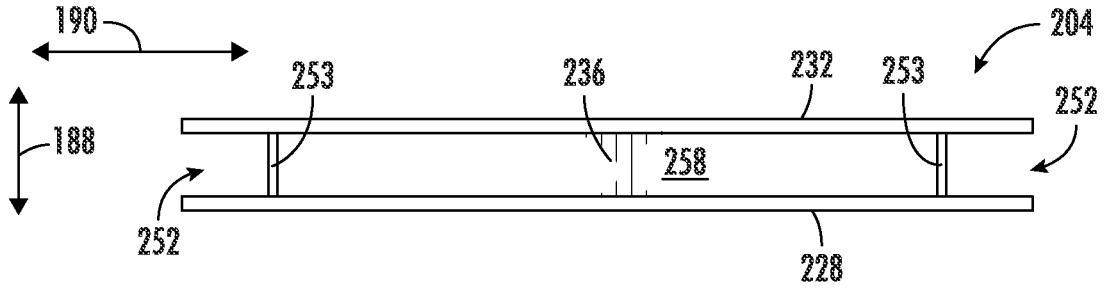
FIG. 4 shows the front rocker unit of FIG. 3.
Figure 5:
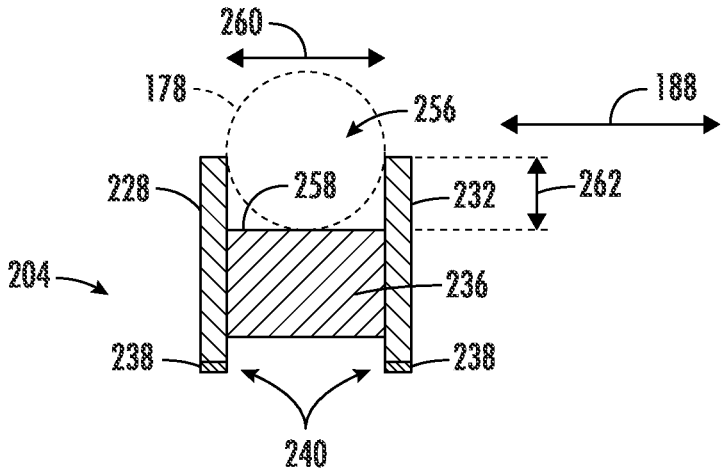
FIG. 5 is a cross sectional view taken along line V-V of FIG. 3.

As shown in FIGS. 3-5, the front rocker unit 204 (i.e., a first rocker unit) includes a front support wall 228, a rear support wall 232 spaced apart from the front support wall 228, and a support block 236 positioned between the support walls 228, 232. The front rocker unit 204 also includes an elastomer strip 238. In one embodiment, the front support wall 228, the rear support wall 232, and the support block 236 are separately formed and fastened together. In another embodiment, the front support wall 228, the rear support wall 232, and the support block 236 are integrally formed and/or molded as a single piece. The front support wall 228, the rear support wall 232, and the support block 228 are formed from a rigid material including solid wood, wood-based composite materials, plastic, metal, or combinations thereof. In a specific embodiment, the front support wall 228, the rear support wall 232, and the support block 228 are integrally formed from injection molded thermoplastic.

The support walls 228, 232 each include an arch-shaped surface 240, a left stop structure 244, a right stop structure 248, and an upper edge 252. The arch-shaped surface 240 is located between the stop structures 244, 248. In one embodiment, the arch-shaped surface 240 is ground-engaging meaning that the arch-shaped surface 240 engages directly the ground, the carpet, and/or the floor on which the exercise system 100 is positioned. As shown in FIG. 5, the front rocker unit 204 includes two of the arch-shaped surfaces 240 that are spaced apart from each other. The arch-shaped surfaces 240 are collectively referred to as the front arch-shaped surface 240 or the front ground-engaging arch-shaped surface 240 of the front rocker unit 204. In other embodiments of the front rocker unit 204, the support walls 228, 232 are integrally formed as a single unit and define a single arch-shaped surface 240 that extends from the support wall 228 to the support wall 232 in the lateral direction 188.

In one embodiment, the arch-shaped surface 240 has a radius based on a height of the seat 170 from the ground. For example, the height of the seat 170 from the ground is 33 inches and the radius of the arch-shaped surface 240 is 104 inches (8.64 feet or 2.64 meters). A radius of 104 inches results in a comfortable tilting experience for the user. At this exemplary radius, the rocking units 204, 208 are configured to provide the exercise system 100 with approximately 18° to 25° of left and right tilt from vertical in the lateral direction 190, as limited by the stop structures 244, 248 and the stabilizing steps 216, 224. Stated differently, the exercise system 100 has a tilting range of from about 36° to 50° as limited by the stop structures 244, 248 and the stabilizing steps 216, 224.

In another embodiment, the radius of the arch-shaped surface 240 is based on a maximum height of the seat 170. For example, when the maximum height of the seat 170 is 40 inches from the ground, then the radius of the arch-shaped surface 240 is 126 inches (10.5 feet or 3.19 meters). An exemplary process for determining a suitable radius of the arch-shaped surface 240 is to multiply the height of the seat 170 from the ground by 3.14.

The arch-shaped surface 240 is also referred to herein as a rocking surface and includes all curved surfaces that rock and/or tilt on the ground. The arch-shaped surface 240, therefore, is not limited to a circular arc having a single radius.

As shown in FIG. 3, the stop structures 244, 248 protrude from the lateral ends of the arch-shaped surface 240. In particular, the stop structure 244 is located at a first end of the arch-shaped surface 240, and the stop structure 248 is located at a second opposite end of the arch-shaped surface 240. In one embodiment, the stop structures 244, 248 are protrusions that define a radius that is much smaller than the radius of the arch-shaped surface 240. An exemplary radius of the stop structures 244, 248 is 2 to 5 inches. Each of the stop structures 244, 248 extends away from the arch-shaped surface 240 toward the ground when the exercise system 100 is positioned as shown in FIGS. 1 and 3.

As shown in FIG. 4, in one embodiment, the support block 236 is shorter in the lateral direction 190 than the support walls 228, 232 so that a space 252 is defined between the support walls 228, 232. In such an embodiment, the connecting members 212, 220 are partially positioned in the space 252, extend through at least one of the support walls 228, 232, and are attached to at least one of the support walls 228, 232. In another embodiment, the support block 236 extends in the lateral direction 190 the same distance as the support walls 228, 232. In such an embodiment, the connecting members 212, 220 extend through at least one of the support walls 228, 232, extend at least partially through the support block 236, and are connected to at least one of the support walls 228, 232 and the support block 236.

With reference to FIG. 5, the front rocker unit 204 defines a cavity 256 configured to receive the front cross member 178 of the stationary bicycle 104. The cavity 256 is defined by the support walls 228, 232 and a support surface 258 of the support block 236. The cavity 256 is defined on three sides and is open on an upper side. In one embodiment, a width 260 of the cavity 256 along the longitudinal axis 188 is at least as wide as a width and/or diameter of the cross member 178. A depth 262 of the cavity 256 in a vertical direction is at least as long as half a height and/or a radius of the cross member 178. Accordingly, the cavity 256 securely receives the cross member 178, and the cross member 178 does not exit the cavity 256 during use of the exercise system 100. When positioned in the cavity 256, the cross member 178 is connected to the front rocker unit 204 and is positioned on the support surface 258 between the first and the second support walls 228, 232. In one embodiment, each end of the support surface 258 is terminated with a wall 253 configured to prevent the cross member 178 from sliding in the lateral direction 190 and exiting the cavity 256.

In another embodiment, the rocker units 204, 208 are configured to operably connect to a different style of stationary bicycle 104 and/or the rocker units 204, 208 are non-removably connected to the connection members of the stationary bicycle 104. For example, the cavity 256 may be configured to receive two front "feet" or supports (not shown) of a different type of stationary bicycle, instead of the cylindrical front cross member 178. The rocker units 204, 208 may be configured to connect to any style and configuration of connection member, cross member 178, 182, and/or stationary bicycle 104.

As also shown in FIGS. 3 and 5, the elastomeric strip 238 is mounted on the arch-shaped surface 240 and to the stop structures 244, 248. In the illustrated embodiment, the elastomeric strip 238 takes the shape of the arch-shaped surface 240 and the stop structures 244, 248, and is the ground-engaging surface of the rocker unit 204. The elastomeric strip 238 is configured to protect the floor surface on which the exercise system 100 is positioned and is also configured to prevent sliding and/or creeping movement of the exercise system 100 during use. The elastomeric strip 238 is formed from a non-slip material including rubber, neoprene, and the like. Additionally, the elastomeric strip 238 dampens sounds that are emitted from the exercise system 100 during use.

In another embodiment, the elastomeric strip 238 is integral with the support walls 228, 232, such as being molded into the support walls 228, 232. In a further embodiment, the support walls 228, 232 do not include the elastomeric strip 238 and, instead, the support walls 228, 232 (including the stop structures 244, 248 and the arch-shaped surfaces 240) are formed from a material that is non-slip and at least partially elastomeric, such as some types of plastic and plastic composite materials.

As shown in FIG. 2, the rear rocker unit 208 (i.e., a second rocker unit) is substantially identical or identical to the front rocker unit 204 and includes a corresponding front support wall 228, a rear support wall 232, a support block 236, and stop structures 244, 248. The rear rocker unit 208 defines another ground-engaging arch-shaped surface 240. The arch-shaped surface 240 of the rear rocker unit 208 has the same or substantially the same profile and/or radius as the arch-shaped surface 240 of the front rocker unit 204. The rear rocker unit 208 defines a cavity 256 to receive and to connect to the rear cross member 182 of the stationary bicycle 104.

In some embodiments, the front and rear rocker units 204, 208 include straps 266 (FIG. 2) or other fastening members to prevent the cross members 178, 182 from being removed from the cavities 256. That is, the straps 266 secure the cross members 178, 182 to the rocker units 204, 208 to further connect the stationary bicycle 104 to the support assembly 108. Suitable straps 266 include hook-and-loop fasteners, fabric with snaps, and clamps. As noted the walls 253 (FIG. 4) also prevent the cross members 178, 182 from sliding in the lateral direction 190 out of the cavity 256.

With reference again to FIG. 2, the connecting members 212, 220 extend from the front rocker unit 204 to the rear rocker unit 208. In one embodiment, the connecting members 212, 220 are formed from metal, such as aluminum, and are rigid and resist bending. As illustrated, the connecting members 212, 220 are cylindrical rods, and may also be referred to herein as connecting rods. In other embodiments, the connecting members 212, 220 have any suitable shape. The connecting members 212, 220 provide rigidity to the support assembly 108 and are configured to prevent movement of the front rocker unit 204 relative to the rear rocker unit 208. That is, the connecting members 212, 220 are configured to prevent twisting of the support assembly 108. The connecting members 212, 220 are the same length so that the rocker units 204, 208 are parallel to each other. The connecting member 212 is located on the left side (i.e., a first side) of the longitudinal axis 188 of the stationary bicycle 104 and extends from the stop structure 244, and the connecting member 220 is located on the right side (i.e., an opposite second side) of the longitudinal axis 188 of the stationary bicycle 104 and extends from the stop structure 248. In one embodiment, the connecting members 212, 220 have threaded ends configured to be received by the threaded openings in the rocker units 204, 208 to connect the connecting members 212, 220 to the rocker units 204, 208.

Figure 6:
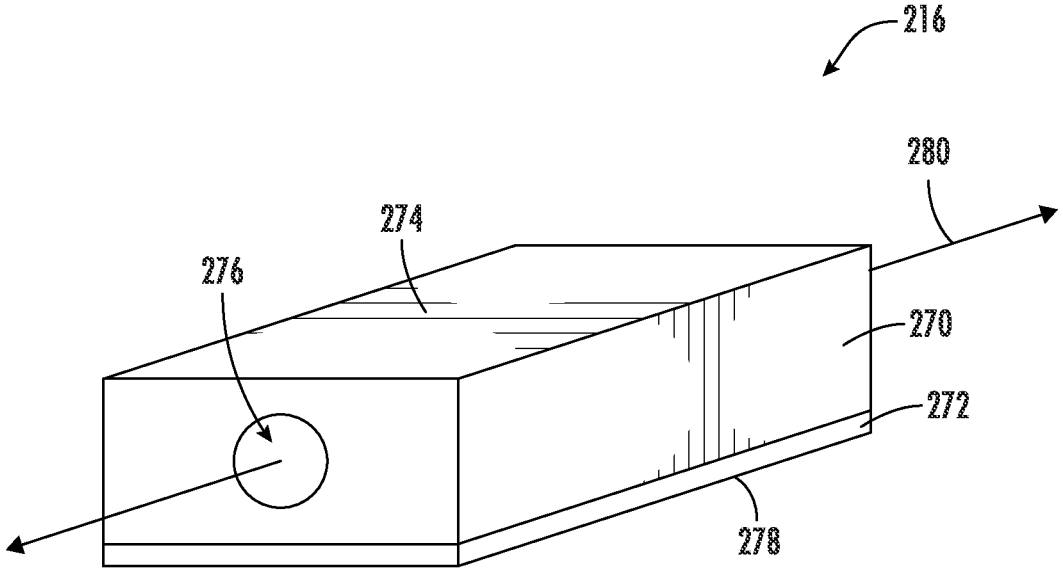
FIG. 6 shows a stabilizing step of the support assembly.

As shown in FIGS. 2 and 6, the support assembly 108 includes two of the stabilizing steps 216, 224. Each stabilizing step 216, 224 is mounted on a corresponding one of the connecting members 212, 220. The stabilizing steps 216, 224 include a block portion 270 and an elastomeric portion 272 defining a stop surface 278. The block portion 270 defines a step surface 274 and a through hole 276 configured to receive one of the connecting members 212, 220. The stop surface 278 is opposite the step surface 274. The stabilizing steps 216, 224 are mounted for rotation on the connecting members 212, 220. In particular, the stabilizing steps 216, 224 rotate about a longitudinal axis 280 defined by the connecting members 212, 220. In one embodiment, the stabilizing steps 216, 224 are centered between the front and the rear rocker units 204, 208 and are prevented from moving in the direction of the longitudinal axes 280 defined by the connecting members 212, 220.

The step surface 274 is substantially flat and may include contours or features to increase a grip level of the step surface 274 against the user's foot, sock, or shoe.

The elastomeric portion 272 is configured to protect the floor surface on which the exercise system 100 is positioned and is also configured to prevent sliding and/or creeping movement of the exercise system 100 during use. The elastomeric portion 272 is connected to the block portion 270 with adhesive or fasteners, for example. The elastomeric portion 272 is formed from a non-slip material including rubber, neoprene, and the like. In another embodiment, the elastomeric portion 272 is integral with the block portion 270, such as being molded into the block portion 270. In a further embodiment, the stabilizing steps 216, 224 do not include the elastomeric portion 272 and, instead, the block portion 270 is formed from a material that is non-slip and at least partially elastomeric, such as some types of plastic and plastic composite materials. In such an embodiment, the block portion 270 defines the stop surface 278. The stop surface 278 is the portion of the stabilizing step 216 that that is configured to engage the ground. The two stabilizing steps 216, 224 are substantially identical or identical.

Figure 7:
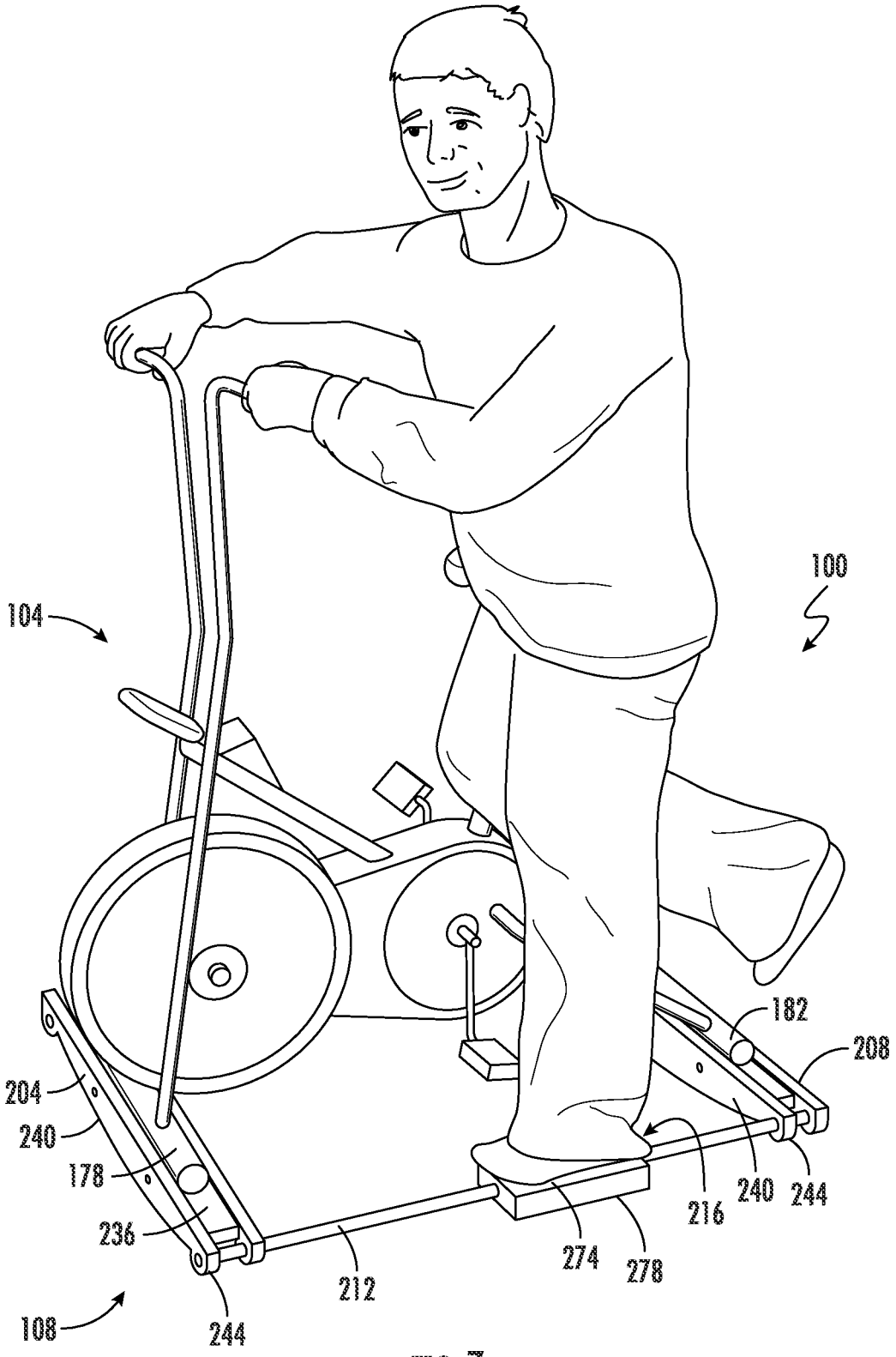
FIG. 7 shows a user standing on the stabilizing step of FIG. 6 to tilt the exercise system into a fixed stationary angled position.
Figure 8:
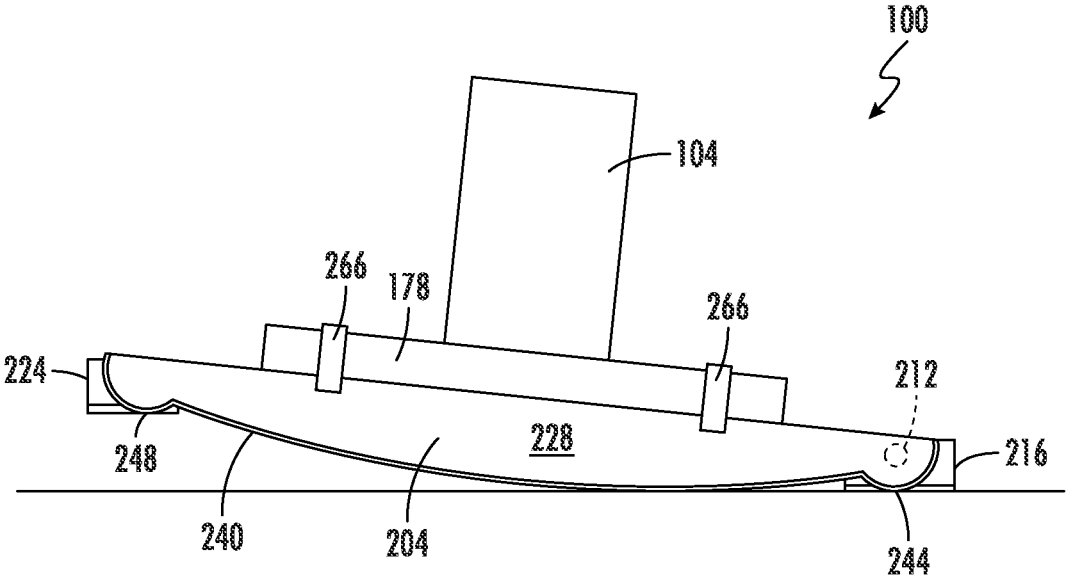
FIG. 8 shows the exercise system in the tilted position of FIG. 7.

With reference to FIG. 7, to mount the stationary bicycle 104, for example, the user grasps the handlebars 174 and steps on the step surface 274, to tilt the exercise system 100 on the arch-shaped surfaces 240 to a position of maximum left tilt. Specifically, the user steps on the step surface 274 of the stabilizing step 216 until the stop surface 278 of the stabilizing step 216 and the stop structures 244 contact the ground (as also shown in FIG. 8). As the user applies pressure to the step surface 274, the exercise system 100 tilts on the arch-shaped surfaces 240 and the stabilizing step 216 rotates relative to the connection member 212 about the longitudinal axis 280 (FIG. 6). The rotation of the stabilizing step 216 causes the elastomeric portion 272 and the stop structures 244 to squarely engage the ground when the exercise system 100 is in the position of maximum left tilt. This provides the user with a solid footing and confidence to stand on the firmly planted stabilizing step 216.

Next, to mount the stationary bicycle 104, the user swings her right leg between the seat 170 and the handlebars 174, and places her right foot on the right pedal 162 of the stationary bicycle 104. Next, the user moves laterally to a center position over the seat 170, transfers her left foot from the left stationary step 216 of the support assembly 108 to the left pedal 162 of the stationary bicycle 104. From here, the user operates the stationary bicycle 104 as normal, using the seat 170 when she desires. The stationary bicycle 104 can be mounted from the right side by following a mirrored procedure that includes stepping on the right stabilizing step 224 to tilt the exercise system 100 to a position of maximum right tilt.

When operating the stationary bicycle 104, the user may choose to laterally shift her body to the left and the right to cause the exercise system 100 to tilt and/or to rock on the rocker units 204, 208 perpendicularly to the longitudinal axis 188. Additionally or alternatively, the user can apply force to the handlebars 174 in the lateral direction 190, which causes the exercise system 100 to tilt and/or rock on the rocker units 204 and 208. During the tilting, the user engages her core muscles including, but not limited to, the rectus abdominis, the transvers abdominis, the internal oblique, the external oblique, and the latissimus dorsi. Tilting the exercise system 100 to the left and the right simulates the leaning motions that occur when turning while riding a traditional bicycle.

In one embodiment, during vigorous exercise for example, the exercise system 100 is configured to tilt to the left with each downward stroke of the left pedal 162 and to tilt to the right with each downward stroke of the right pedal 162. This type of tilting is achievable by the exercise system 100 with the user in both the seated and the standing position and very accurately simulates the leaning and tilting that occurs when vigorously riding a traditional bicycle. In the standing position, the user's feet are on the pedals 162, but she is not sitting on the seat.

When operating the stationary bicycle 104 the user may further choose to maintain her body in a laterally-centered position. In such a centered position, the stationary bicycle 104 either does not rock on the rocking units 204, 208 or only minimally rocks on the rocking units 204, 208. As such, the user can choose how much lateral rocking occurs when operating the exercise system 100 by controlling the force with which she pedals the pedals 162 and the lateral position of her body while pedaling, or by controlling the force applied to the handlebars 174 along the lateral axis 190. If the user so chooses, the exercise system 100 can be operated with little to no leaning, tilting, and rocking.

To dismount the stationary bicycle 104, the user grips the handlebars 174 and shifts her body laterally to the left to lean the exercise system 100 to the position of maximum left tilt, as shown in FIG. 8. Then, the user places her left foot on the stabilizing step 216 to hold the exercise system 100 in the position of maximum left tilt and swings her right foot between the seat 170 and the handlebars 174 and onto the ground. Next, the user steps off the stabilizing step 216 and returns the exercise system 100 to the neutral position using the handlebars 174. The stationary bicycle 104 can be dismounted from the right side by following a mirrored procedure that includes stepping on the right stabilizing step 224 to hold the exercise system 100 in the position of maximum right tilt.

With reference to FIGS. 7 and 8, the exercise system 100 is configured to limit tilting on the arch-shaped surfaces 240 to no further than the positions of maximum left and right tilt. For example, in the position of maximum left tilt, each of the left stabilizing step 216, the left stop structure 244 of the front rocker unit 204, and the left stop structure 244 of the rear rocker unit 208 engage the ground to provide the exercise system 100 with a front, middle, and rear stabilization point. In this embodiment, the connecting member 212 is spaced apart from the ground in the position of maximum left tilt. Similarly, in the position of maximum right tilt, each of the right stabilizing step 224, the right stop structure 248 of the front rocker unit 204, and the right stop structure 248 of the rear rocker unit 208 engage the ground to provide the exercise system 100 with a front, middle, and rear stabilization point. In this embodiment, the connecting member 220 is spaced apart from the ground in the position of maximum right tilt. The arch-shaped surfaces 240 also engage the ground at the positions of maximum tilt and at all positions therebetween. With three lateral points of stabilization at the positions of maximum tilt, the exercise system 100 is prevented from further tilting and is prevented from tilting to a position that causes the exercise system 100 to over rotate and/or to topple over.

As illustrated in FIGS. 1-8, the exercise system 100 includes the stationary bicycle 104 operably connected to the support assembly 108. The stationary bicycle 104 is usable both with and without the support assembly 108. That is, the stationary bicycle 104 may be positioned with the cross members 178, 182 on the ground instead of connected to the support assembly 108. In such a configuration, the stationary bicycle is not configured for lateral leaning and/or tilting. Thus, the exercise system 100 is a versatile and customizable assembly that allows operation of the stationary bicycle 104 in both a lateral leaning configuration (i.e., with the support assembly 108) and a non-lateral leaning configuration (i.e., without the support assembly 108). In another embodiment, the stationary bicycle 104 and the support assembly 108 are an integrated unit and the stationary bicycle 104 is usable only with the support assembly 108 in the lateral leaning configuration. That is, in such a configuration, the stationary bicycle 104 cannot be separated from the support assembly 108 and positioned on the ground for non-lateral leaning operation.

As shown in FIGS. 9-15 another embodiment of the exercise system 100' includes a different structure for stabilizing the exercise system 100' at the positions of maximum tilting. The exercise system 100' includes the stationary bicycle 104 and a support assembly 108'. A difference between the support assemblies 108, 108' is that the support assembly 108' does not include the stabilizing steps 216, 224. Instead, the connecting members 212' operate as the stabilizing steps 216, 224 and the stop structures 244, 248. That is, the connecting members 212' engage the ground to stabilize the exercise system 100' and to prevent over rotation of the exercise system 100'. Accordingly, the connecting members 212' are configured as the stop structures 244', 248' and/or are part of the stop structures 244', 248'.

Figure 10:
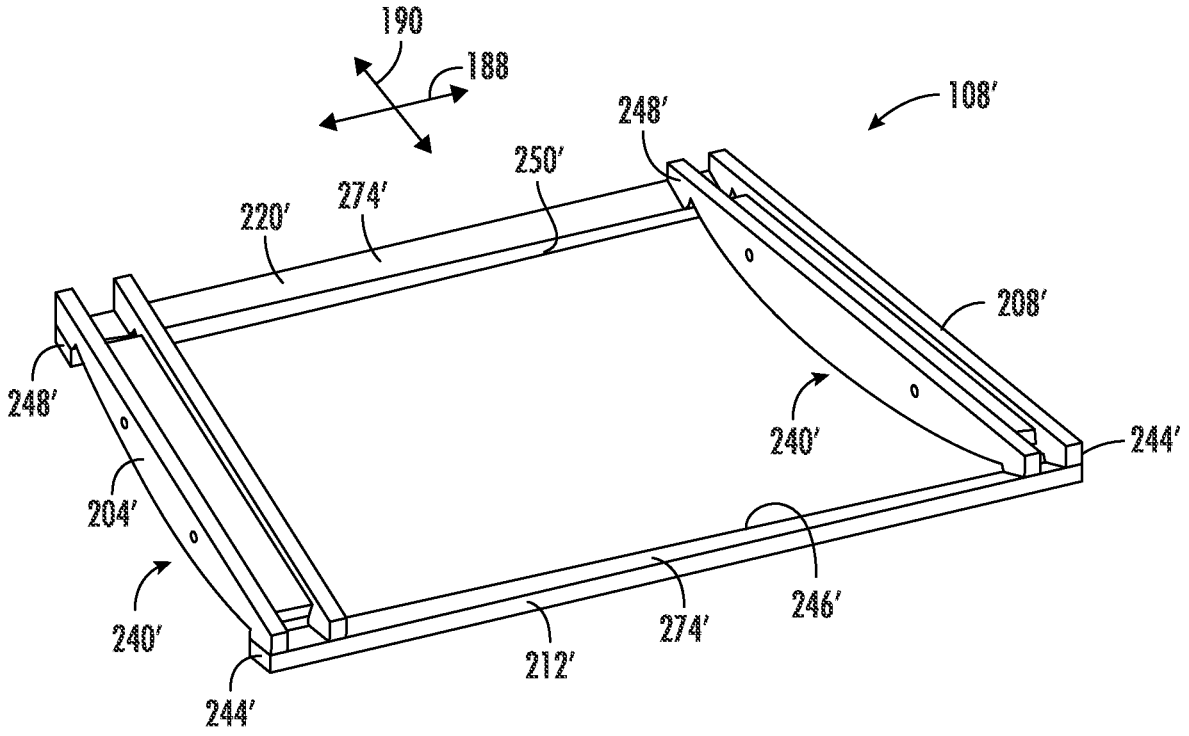
FIG. 10 shows the support assembly of FIG. 9 without the stationary bicycle.

With reference to FIG. 10, the support assembly 108' includes a front rocker unit 204', a rear rocker unit 208', a left connecting member 212', and a right connecting member 220'. The connecting members 212', 220' are configured to connect the rocker units 204', 208' together.

Figure 11:
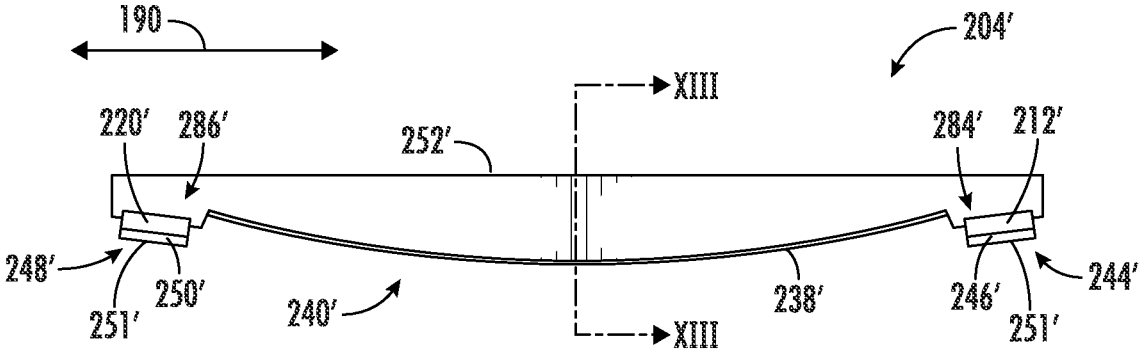
FIG. 11 shows a front rocker unit of the support assembly of FIG. 10.
Figure 12:
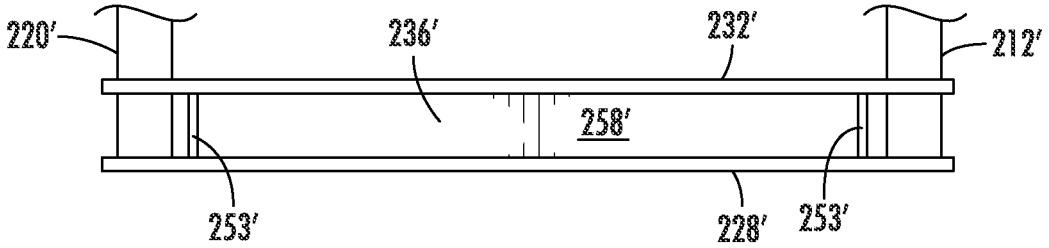
FIG. 12 shows the front rocker unit of FIG. 11.
Figure 13:
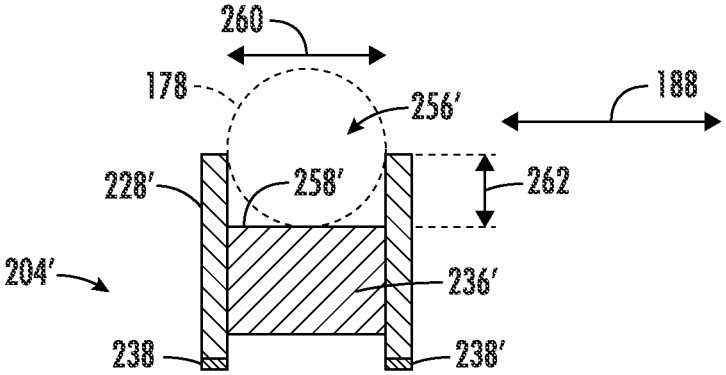
FIG. 13 is a cross sectional view taken along line XIII-XIII of FIG. 11.

As shown in FIGS. 11-13, the front rocker unit 204' includes a front support wall 228', a rear support wall 232', and a support block 236' positioned between the support walls 228', 232'. The front rocker unit 204' also includes an elastomer strip 238'. In one embodiment, the front support wall 228', the rear support wall 232', and the support block 236' are separately formed and fastened together. In another embodiment, the front support wall 228', the rear support wall 232', and the support block 236' are integrally formed and/or molded as a single piece. The front support wall 228', the rear support wall 232', and the support block 228' are formed from a rigid material including solid wood, wood-based composite materials, plastic, or combinations thereof. In a specific embodiment, the front support wall 228', the rear support wall 232', and the support block 228' are integrally formed from injection molded thermoplastic.

The support walls 228', 232' each include a ground-engaging arch-shaped surface 240' and an upper edge 252'. The arch-shaped surface 240' is located between the stop structures 244', 248'. The arch-shaped surface 240' engages the ground and/or the floor on which the exercise system 100' is positioned. As shown in FIG. 13, the front rocker unit 204' includes two of the arch-shaped surfaces 240' that are spaced apart from each other. The arch-shaped surfaces 240' are collectively referred to as the front arch-shaped surface 240' or the arch-shaped surface 240' of the front rocker unit 204'. In other embodiments of the front rocker unit 204', the support walls 228', 232' are integrally formed and define a single arch-shaped surface 240' that extends from the support wall 228' to the support wall 232'.

The arch-shaped surface 240' has substantially the same radius or the same radius as the arch-shaped surface 240.

Figure 9:
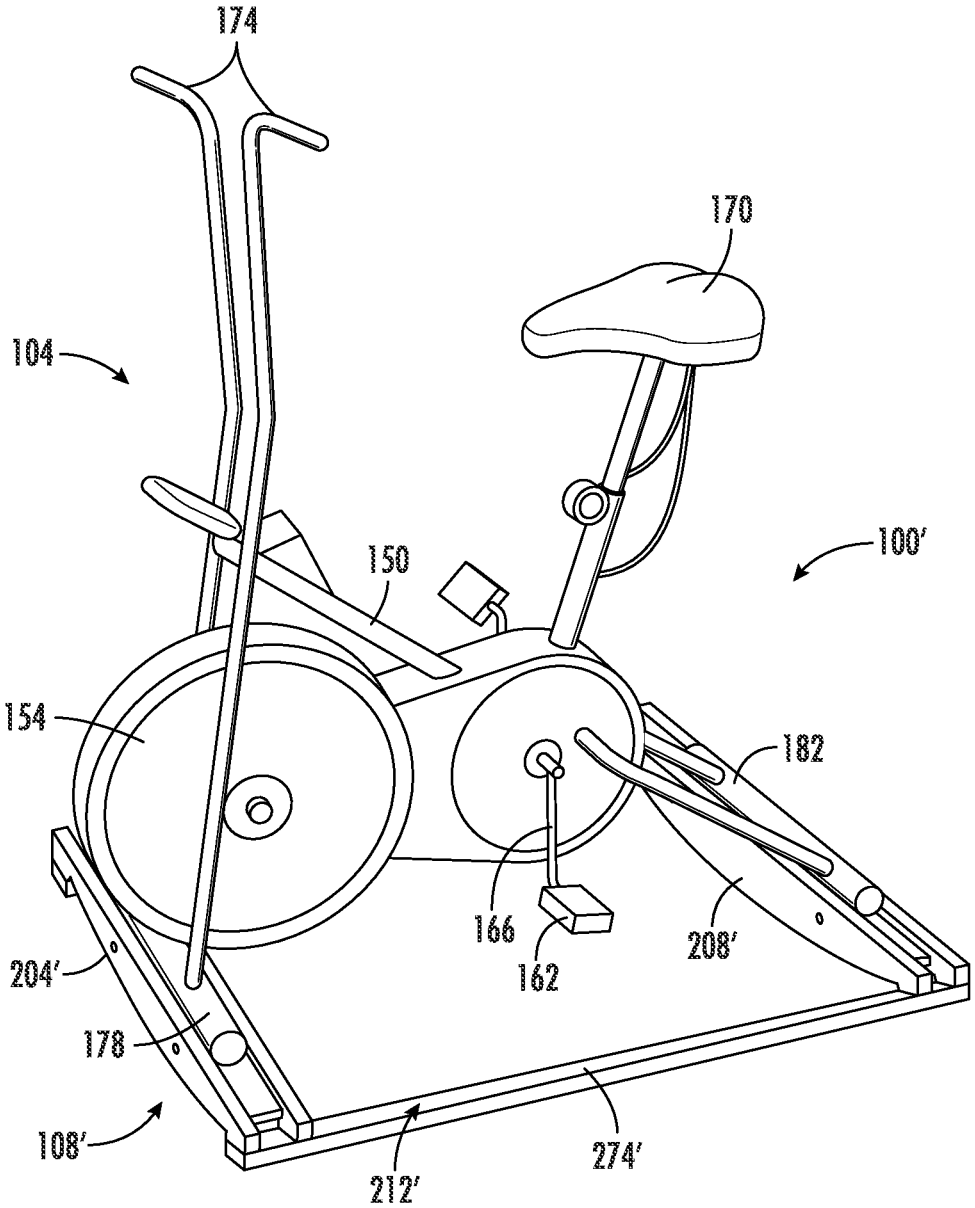
FIG. 9 shows another embodiment of an exercise system including the stationary bicycle of FIG. 1 and a different support assembly.

As shown in FIG. 11, a bottom surface 246', 250' of the connecting members 212', 220' protrudes from the lateral ends of the arch-shaped surface 240. Accordingly, the bottom surfaces 246', 250' of the connecting members 212', 220' are configured as the stop structures 244', 248'. Each of the stop structures 244', 248' extends away from the arch-shaped surface 240' toward the ground when the exercise system 100' is positioned as shown in FIGS. 9 and 10.

With reference to FIG. 13, the front rocker unit 204' defines a cavity 256' to receive the front cross member 178 of the stationary bicycle 104. The cavity 256' is defined by the support walls 228', 232' and a support surface 258' of the support block 236'. The cavity 256' is defined on three sides and is open on an upper side. In one embodiment, a width 260 of the cavity 256' along the longitudinal axis 188 is at least as wide as a width and/or diameter of the cross member 178. A depth 262 of the cavity 256' in a vertical direction is at least as long as half a height and/or a radius of the cross member 178. Accordingly, the cavity 256' securely receives the cross member 178, and the cross member 178 does not exit the cavity 256' during use of the exercise system 100'. In one embodiment, each end of the support surface 258' is terminated with a wall 253' configured to prevent the cross member 178 from sliding in the lateral direction 190 and exiting the cavity 256'.

In another embodiment, the cavity 256' is configured to operably connect to a different style of stationary bicycle 104. For example, the cavity 256' may be configured to receive two front "feet" (not shown) of a different type of stationary bicycle, instead of the cylindrical front cross member 178. The cavity 256 may be configured to connect to any style and configuration of stationary bicycle 104.

As also shown in FIGS. 11 and 13, the elastomeric strip 238' is applied to the arch-shaped surface 240. The elastomeric strip 238' is configured to protect the floor surface on which the exercise system 100' is positioned and is also configured to prevent sliding and/or creeping movement of the exercise system 100' during use. The elastomeric strip 238' is formed from a non-slip material including rubber, neoprene, and the like. Additionally, the elastomeric strip 238' dampens sounds that are emitted from the exercise system 100' during use. In another embodiment, the elastomeric strip 238' is integral with the support walls 228', 232', such as being molded into the support walls 228', 232'. In a further embodiment, the support walls 228', 232' do not include the elastomeric strip 238' and, instead, the support walls 228', 232' (including the arch-shaped surfaces 240') are formed from a material that is non-slip and at least partially elastomeric, such as some types of plastic and plastic composite materials.

The support walls 228', 232' define the shape of the ground-engaging arch-shaped surface 240'; however, in at least some embodiments, including the illustrated embodiment, the elastomeric strip 238' is the ground-engaging component of the front rocker unit 204'.

The rear rocker unit 208' is substantially identical or identical to the front rocker unit 204' and includes a corresponding front support wall 228', a rear support wall 232', a support block 236', and stop structures 244', 248'. The rear rocker unit 208' defines another ground-engaging arch-shaped surface 240'. The arch-shaped surface 240' of the rear rocker unit 208' has the same and/or substantially the same profile and radius as the arch-shaped surface 240' of the front rocker unit 204'. The rear rocker unit 208' defines a cavity 256' to receive the rear cross member 182 of the stationary bicycle 104.

With reference again to FIG. 10, the connecting members 212', 220' extend from the front rocker unit 204' to the rear rocker unit 208'. In one embodiment, the connecting members 212', 220' are formed from metal, such as aluminum, and are rigid and resist bending. As illustrated, the connecting members 212', 220' are rectangular rods. In other embodiments, the connecting members 212', 220' have any suitable shape that includes the flat bottom surfaces 246', 250'. The connecting members 212', 220' provide rigidity to the support assembly 108' and are configured to prevent movement of the front rocker unit 204' relative to the rear rocker unit 208'. That is, the connecting members 212', 220' are configured to prevent twisting of the support assembly 108'. The connecting members 212', 220' are the same length so that the rocker units 204', 208' are parallel to each other. In some embodiments, the bottom surfaces 246', 250' of the connecting members 212', 220' contact the ground directly during maximum tiling of the exercise system 100'. In other embodiments, a corresponding elastomeric strip 251' (FIG. 11) is applied to each bottom surface 246', 250' or to at least a portion of each bottom surface 246', 250'. When included, the elastomeric strips 251' are configured to contact the ground during maximum tiling of the exercise system 100'.

As shown in FIG. 11, the support walls 228', 232' include notches 284', 286' configured to receive the connecting members 212', 220' and to position the bottom surfaces 246', 250' at a predetermined angle. The connecting members 212', 220' are fixedly connected to the rocking units 204', 208' at the notches 284', 286' with adhesive or another type of fastener, such as screws. The predetermined angle is selected so that the bottom surfaces 246', 250' (and/or the elastomeric strips 251') are parallel to the ground and make full contact with the ground when the exercise system 100' is in the positions of maximum left and right tilt. The elastomeric strips 238' of the arch-shaped surfaces 240' also engage the ground during tilting of the exercise system 100' including at the positions of maximum left and right tilt.

Figure 14:
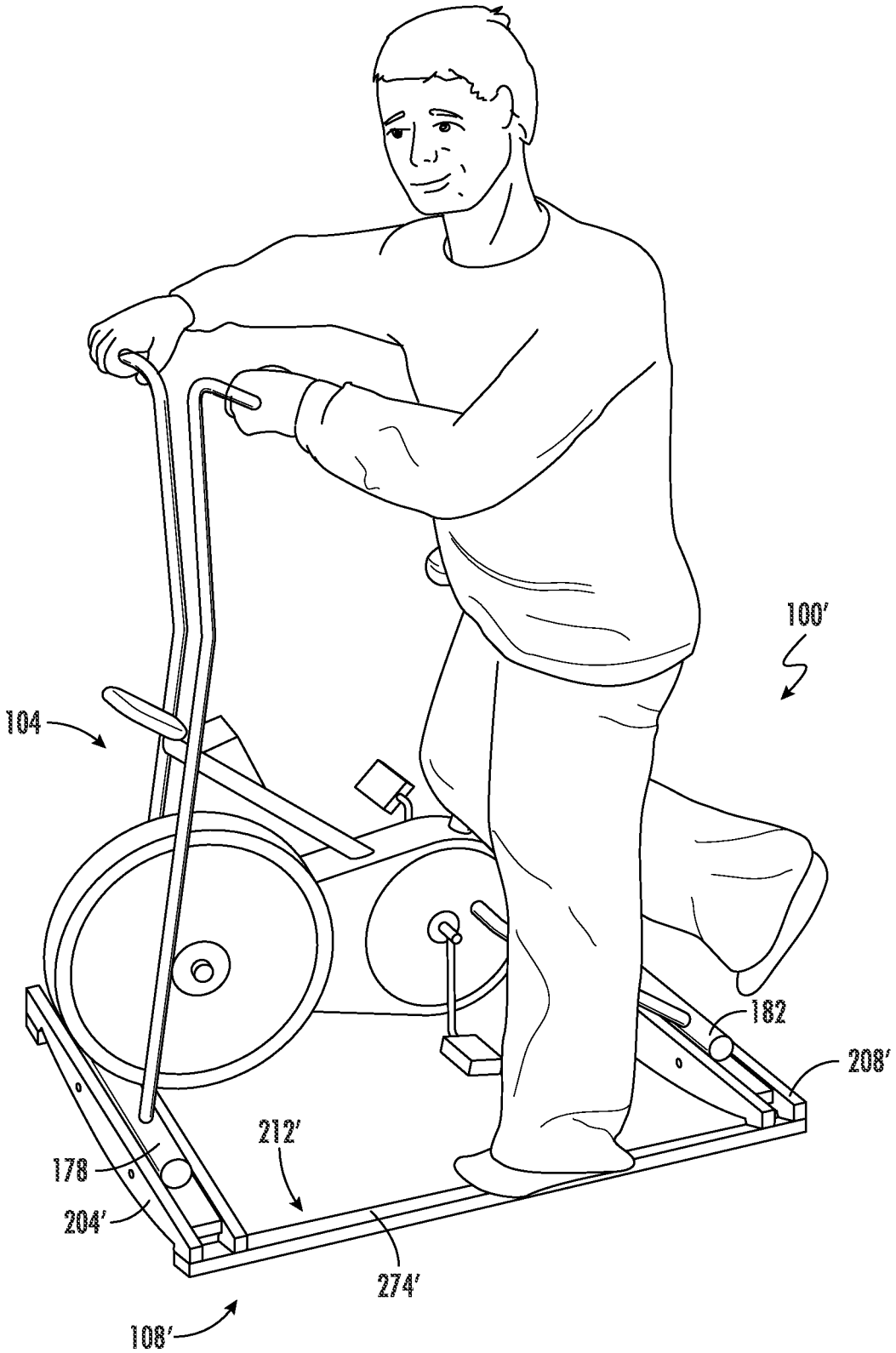
FIG. 14 shows a user standing on a step surface of a connection member of the support assembly of FIG. 10 to tilt the exercise system into a fixed stationary angled position.
Figure 15:
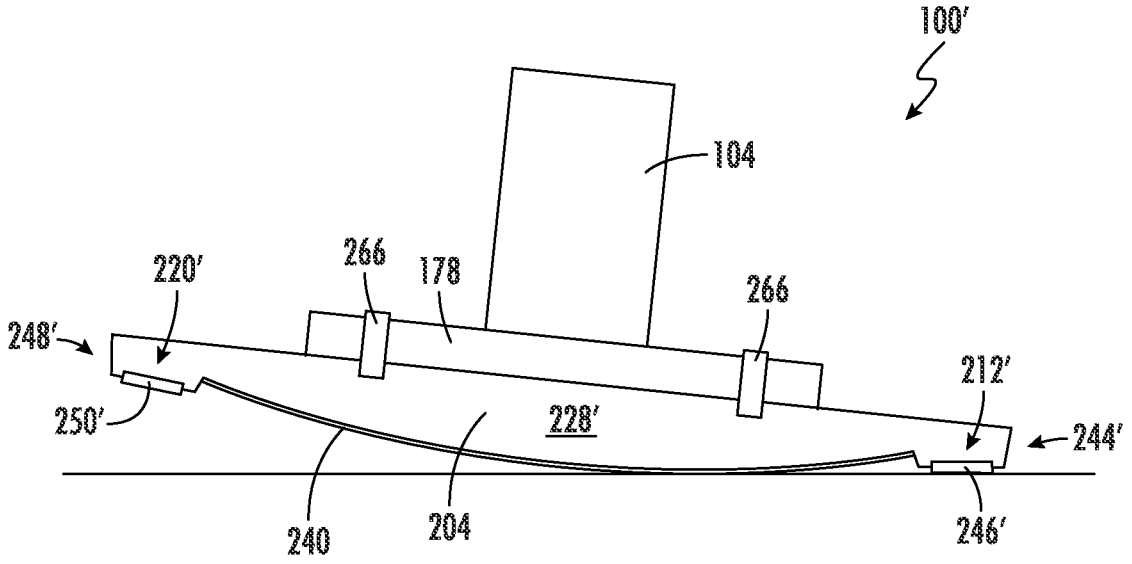
FIG. 15 shows the exercise system in the tilted position of FIG. 14.

With reference to FIGS. 14 and 15, the stop structures 244', 248' formed by the bottom surfaces 246', 250' are configured to engage the ground in the positions of maximum left and right tilt to prevent further tilting of the exercise system 100'. The exercise system 100' is shown in FIGS. 14 and 15 in the position of maximum left tilt. In this position, the bottom surface 246' of the connecting member 212' engages the ground to stabilize the exercise system 100'. The entire length of the connecting member 212' as measured in the longitudinal direction 188 engages the ground. The arch-shaped surfaces 240' also engage the ground at the positions of maximum tilt and at all positions therebetween to prevent further tilting.

As shown in FIG. 10, the connecting members 212', 220' each include a step surface 274'. With reference to FIG. 14, to mount the stationary bicycle 104, for example, the user grasps the handlebars 174 and places her left foot on the step surface 274', to tilt the exercise system 100' to the position of maximum left tilt. The user may step on any portion along the length of the connecting member 290'. As the user applies pressure to the step surface 274', the exercise system 100' tilts until the bottom surface 246' squarely engages the ground with the exercise system 100' in the position of maximum left tilt. This provides the user with a solid footing and confidence to stand on the firmly planted connection member 212'. The bottom surface 246' squarely engages the ground due to the bottom surface 246' being oriented at the predetermined angle.

The exercise system 100' is configured to limit tilting to no further than the positions of maximum left and right tilt. For example, in the position of maximum left tilt, the entire length of the bottom surface 246' of the connecting member 212' engages the ground to provide the exercise system 100' with a large stabilization area. Similarly, in the position of maximum right tilt, the bottom surface 250' of the connecting member 220' engages the ground to provide the exercise system 100' with a large stabilization area. The arch-shaped surfaces 240' also engage the ground at the positions of maximum tilt and at all positions therebetween. With the large stabilization area at the positions of maximum tilt, the exercise system 100' is prevented from further tilting and is prevented from tilting to a position that causes the exercise system 100' to over rotate and to topple over.

In another embodiment of the exercise system 100, the support assembly 108 includes the stabilizing steps 216, 224, but does not include the stop structure 244, 248. In such, an embodiment, the stop surfaces 278 of the stabilizing steps 216, 224 provide sufficient support to limit the exercise system 100 to tilting no further than the positions of maximum left and right tilt. Such an embodiment also prevents the over rotation of the exercise system 100.

In a further embodiment of the exercise system 100, the support assembly 108 includes the two rocker units 204, 208, but includes only one of the connecting members 212, 220. In this embodiment, the one connecting member 212, 220 is mounted to a lateral center of the rocker units 204, 208, and includes lateral extension arms (not shown) to which the stabilizing steps 216, 224 are mounted.

As shown in FIGS. 16-21 another embodiment of the exercise system 300 includes a different structure for stabilizing the exercise system 300 at the positions of maximum tilting and/or leaning that used in addition to or in the alternative of the stop structures 244, 248. The exercise system 300 includes the stationary bicycle 304, a first rocker unit 404, and a second rocker unit 408. A difference between the exercise systems 100, 100' and the exercise system 300 is that the exercise system 300 does not require the connecting members 212, 220, 212', 220' and includes a different structure for preventing over tilting of the stationary bicycle 304.

The stationary bicycle 304 includes a frame 350, a flywheel 354, a pedal assembly 358 having pedals 362 and a crankshaft 366, a seat 370, handlebars 374, a front connection member 378, and a rear connection member 382. The frame 350 is typically formed from metal and/or another strong and rigid material or materials. The flywheel 354 is mounted on the frame 350 for rotation. The pedal assembly 358 is mounted on the frame 350 and is operably connected to the flywheel 354 to rotate the flywheel 354. The front and rear connection members 378, 382 are fixed in position relative to the frame 350. The front and rear connection members 378, 382 are operably connected to the front and rear rocker units 404, 408, respectively. Alternatively, the front and rear connection members 378, 382 are integrally formed with the front and rear rocker units 404, 408, respectively.

Figure 17:
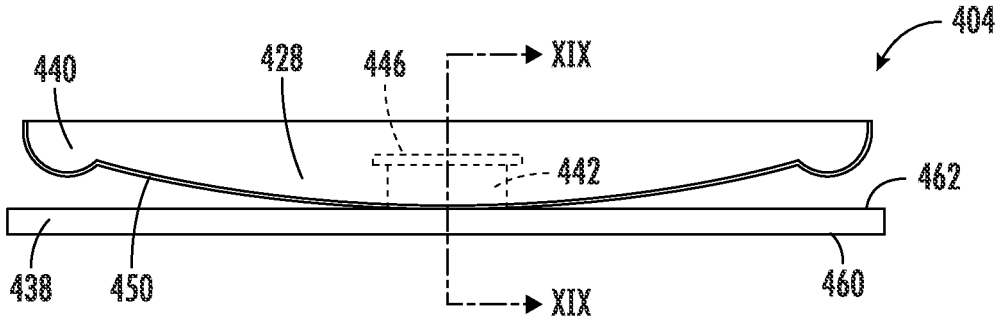
FIG. 17 shows the front rocker unit of FIG. 16.
Figure 18:
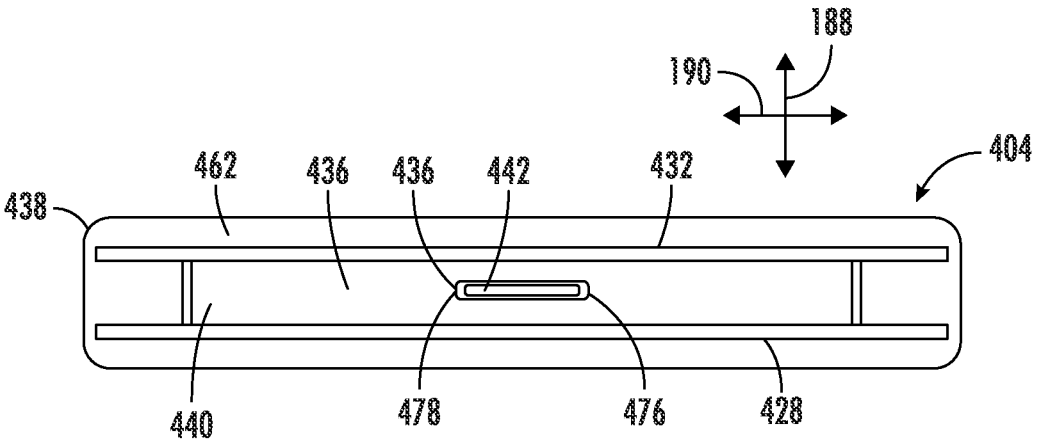
FIG. 18 shows the front rocker unit of FIG. 16.
Figure 19:
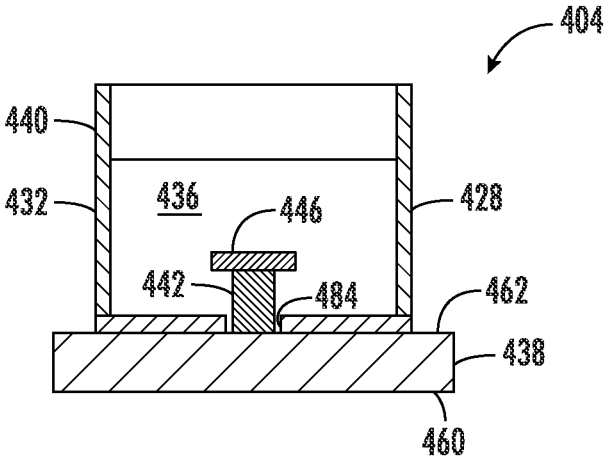
FIG. 19 is a cross sectional view taken along line XIX-XIX of FIG. 17.

As shown in FIGS. 17 and 18, the front rocker unit 404 includes a ground-engaging support 438, a rocker structure 440, and a guide post 442 (shown in phantom in FIG. 17) having a cap 446 (also shown in phantom in FIG. 17). The support 438 defines a planar surface 460 positioned on the ground, and an opposite planar surface 462 on which the rocker structure 440 tilts and rocks during tilting of the stationary bicycle. The support 438 is configured, in one embodiment, to prevent the tilting of the rocker structure 440 from damaging the floor on which the exercise system 300 is positioned.

The rocker structure 440 includes a front support wall 428, a rear support wall 432, and a curved member 436 positioned between the support walls 428, 432 and defining an arch-shaped surface 450. In some embodiments, the rocker structure 440 also includes an elastomer strip (not shown) applied to the arch-shaped surface 450. In one embodiment, the front support wall 428, the rear support wall 432, and the curved member 436 are separately formed and fastened together. In another embodiment, the front support wall 428, the rear support wall 432, the curved member 436, and the front connecting member 378 are integrally formed and/or molded as a single piece. The front support wall 428, the rear support wall 432, and the curved member 436 are formed from a rigid material including solid wood, wood-based composite materials, plastic, metal or combinations thereof. In a specific embodiment, the front support wall 428, the rear support wall 432, and the curved member 436 are integrally formed from injection molded thermoplastic and mounted on the front connecting member 378 of the stationary bicycle 304.

The curved member 436 defines a guide slot 464 that extends through the curved member 436. The guide slot 464, in one embodiment, is centered on the curved member 436 in the longitudinal direction 188 and in the lateral direction 190. The guide slot 464 extends completely through the curved member 436.

The guide post 442 is fixedly mounted on the support 438 and extends upwards from the planar surface 462. In FIG. 18, the rocker unit 404 is shown without the cap 446 so that the fitment of the guide post 442 in the guide slot 464 is visible. The guide post 442 is shorter in the lateral direction 190 than the length of the guide slot 464 in the lateral direction 190. The guide post 442 is narrower in the longitudinal direction 188 than the width of the guide slot 464 in the longitudinal direction 188. Accordingly, the guide slot 464 loosely receives the guide post 442, and the rocker structure 440 is movable relative to the support 438 and the guide post 442 when the guide post 442 is positioned in the guide slot 464.

The cap 446 is connected to an upper end of the guide post 442 opposite the ground-engaging support 438. The cap 446 is larger than the guide slot 464 in the longitudinal direction 188 and the lateral direction 190 (i.e., in at least one dimension) to prevent removal of the guide post 442 from the guide slot 464. That is, the rocker structure 440 can be moved and lifted relative to the guide post 442 until an upper surface of curved structure 436 contacts an underside of the cap 446, which prevents further movement.

Figure 16:
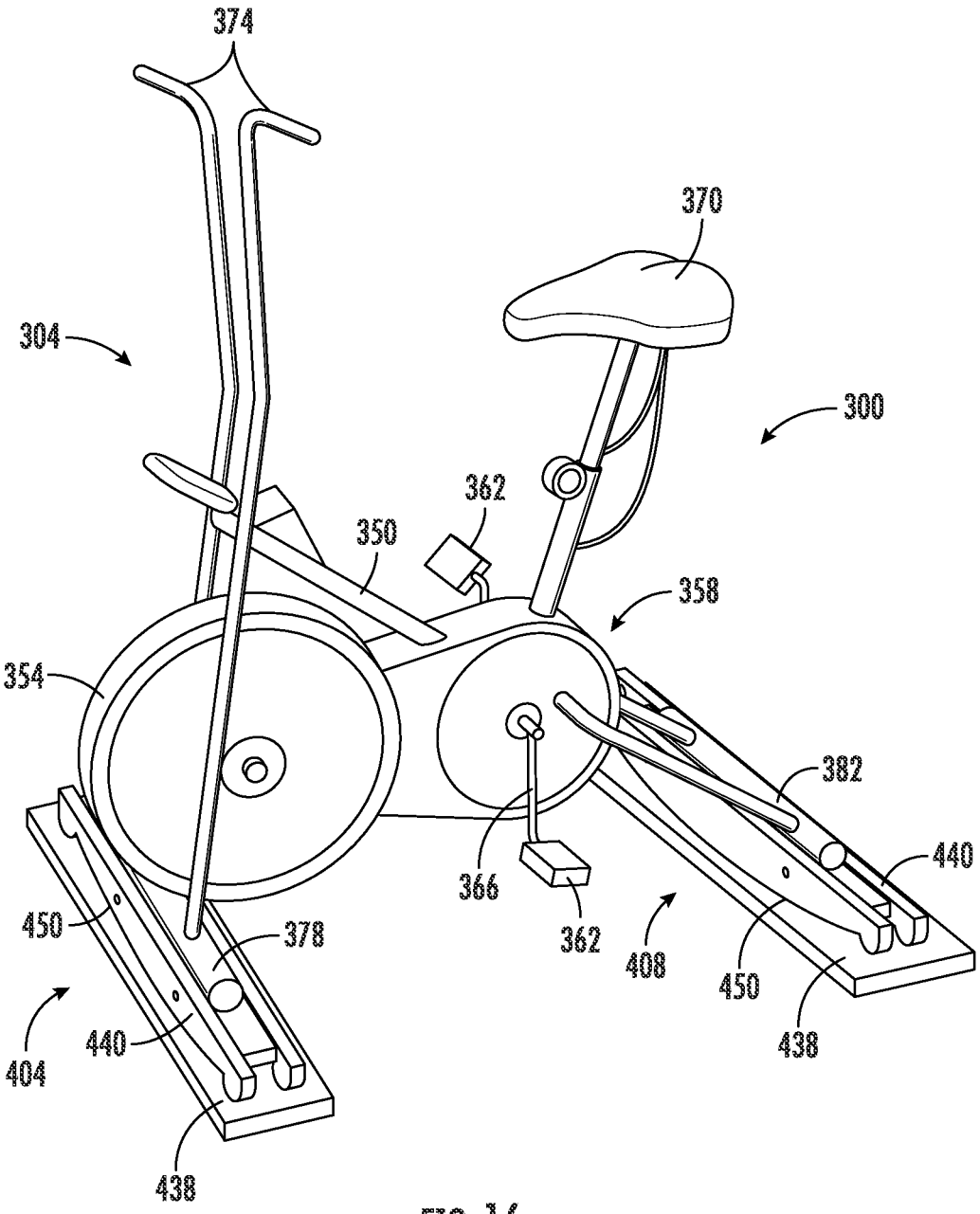
FIG. 16 shows another embodiment of an exercise system including a stationary bicycle, a front rocker unit, and a rear rocker unit.

The rear rocker unit 408 is substantially identical or identical to the front rocker unit 404 and includes a corresponding ground-engaging support 438 and a rear rocker structure 440. FIGS. 17-21 are illustrative of both the front and the rear rocker units 404, 408. Accordingly, the rear rocker unit 408 includes the same guide slot 464 and the same guide post 442 configuration as the front rocker unit 404. As shown in FIG. 16, the front rocker unit 404 is spaced apart from the rear rocker unit 408. In another embodiment (not illustrated), the exercise system 400 includes the stabilizing steps 274 and the connecting members 212, 220, 212', 220' that connect the front and rear rocker units 404, 408.

Figure 20:
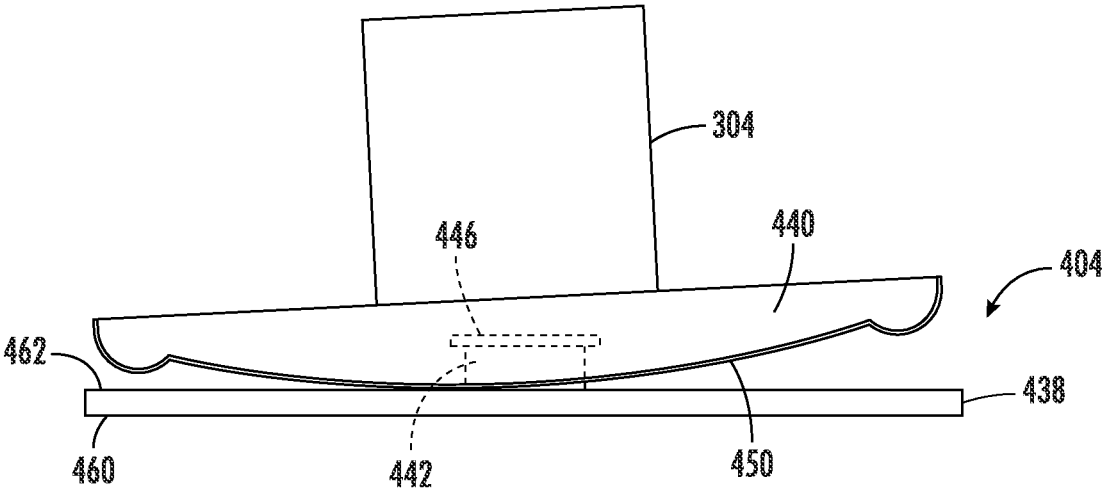
FIG. 20 shows the exercise system of FIG. 16 in a tilted position.
Figure 21:
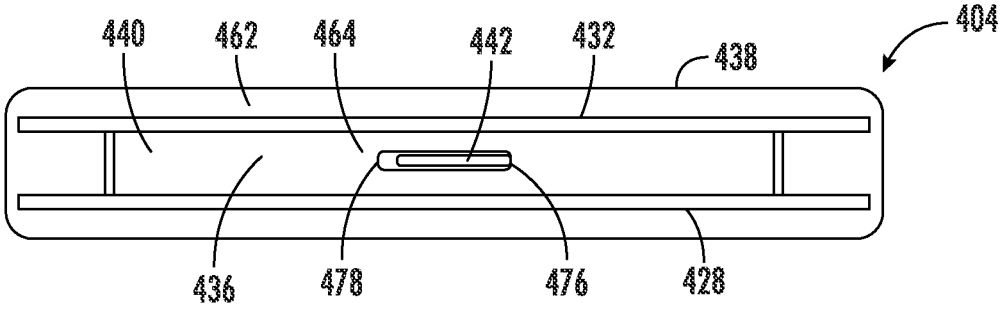
FIG. 21 shows the front rocker unit in the tilted position of FIG. 20 without the stationary bicycle.

As shown in FIGS. 20 and 21, the stationary bike 304 and the rocker structures 440, 444 are configured to rock and/or tilt laterally relative to the ground-engaging supports 438 during operation of the stationary bicycle 304 in order to simulate the lateral movements of a bicycle and to increase the workout level of using the exercise system 300. In particular, the stationary bicycle 304 is configured to tilt on the arch-shaped surfaces 450 between a position of maximum left tilt (not shown) and a position of maximum right tilt (FIGS. 20 and 21).

The exercise system 400 is configured to limit tilting to no further than the positions of maximum left and right tilt. In particular, as shown in FIGS. 20 and 21, at the position of maximum right tilt, the front rocker structure 440 engages the front guide post 442 at a first edge 476 (FIG. 21) of the front guide slot 464, and the rear rocker structure 440 engages the rear guide post 442 at a first edge 476 of the rear guide slot 464. To stop further tilting, a portion of the curved member 436 located at an end of the guide slot 464 (i.e., the first edge 476) contacts the guide post 442 and prevents any further tilting of the rocker structures 440 towards the right. At the position of maximum left tilt, the front rocker structure 440 engages the front guide post 442 at an opposite second edge 478 (FIG. 21) of the front guide slot 464, and the rear rocker structure 440 engages the rear guide post 442 at an opposite second edge 478 of the rear guide slot 464. To stop further tilting, a portion of the curved member 436 located at an opposite end of the guide slot 464 (i.e., the second edge 478) contacts the guide post 442 and prevents any further tilting towards the left. The guide post 442 and guide slot 464 of the exercise system 300 prevents the stationary bicycle 304 from tilting to a position that causes the exercise system 300 to over rotate and to topple over. As shown in FIG. 20, the stop structure (i.e., stop structure 244 of FIG. 8) need not contact the surface 462 in order to limit the tilting. Instead, the interference between the guide post 442 and the guide slot 464 is sufficient to limit the tilting to no further than what is shown in FIG. 20.

Moreover, the ground-engaging supports 438 of the rocker units 404, 408 protect the floor on which the exercise system 300 is located and also prevents the exercise system 300 from moving on the floor during use of the exercise system 300.

While the disclosure has been illustrated and described in detail in the drawings and foregoing description, the same should be considered as illustrative and not restrictive in character. It is understood that only the preferred embodiments have been presented and that all changes, modifications and further applications that come within the spirit of the disclosure are desired to be protected.

What is claimed is:

1. A support assembly for connection to a stationary bicycle having a front cross member and a rear cross member, the support assembly comprising:

a first rocker unit configured to operably connect to the front cross member, the first rocker unit defining a first ground-engaging arch-shaped surface;

a second rocker unit configured to operably connect to the rear cross member, the second rocker unit defining a second ground-engaging arch-shaped surface;

a first connecting member extending from the first rocker unit to the second rocker unit; and a second connecting member extending from the first rocker unit to the second rocker unit, wherein the first rocker unit comprises (i) a first support wall, (ii) a second support wall spaced apart from the first support wall, and (iii) a support block positioned between the first and second support walls, the support block defining a support surface, and wherein the front cross member is positioned on the support surface and between the first and second support walls when the front cross member is operably connected to the first rocker unit.

2. The support assembly as claimed in claim 1, further comprising:

a stabilizing step mounted on the first connecting member.

3. The support assembly as claimed in claim 2, wherein:

the support assembly, with the stationary bike operably connected thereto, is configured to tilt on the first and second arch-shaped surfaces between a position of maximum left tilt and a position of maximum right tilt, the first rocker unit includes a first stop structure at a first end of the first arch-shaped surface and a second stop structure at a second end of the first arch-shaped surface, the second rocker unit includes a third stop structure at a first end of the second arch-shaped surface and a fourth stop structure at a second end of the second arch-shaped surface, and at the position of maximum left tilt, each of the first arch-shaped surface, the second arch-shaped surface, the first stop structure, the third stop structure, and the stabilizing step engage the ground.

4. The support assembly as claimed in claim 3, wherein at the position of maximum left tilt, the first connecting member and the second connecting member are spaced apart from the ground.

5. The support assembly as claimed in claim 2, further comprising:

a first elastomeric strip mounted on the first arch-shaped surface, a second elastomeric strip mounted on the second arch-shaped surface, and an elastomeric portion mounted on the stabilizing step.

6. The support assembly as claimed in claim 1, wherein:

the stationary bicycle defines a longitudinal axis, and when the stationary bicycle is operably connected to the first rocker unit and the second rocker unit, the first connecting member is located on a first side of the longitudinal axis and the second connecting member is located on an opposite second side of the longitudinal axis.

7. The support assembly as claimed in claim 1, wherein:

the support assembly, with the stationary bike operably connected thereto, is configured to tilt on the first and second arch-shaped surfaces to a position of maximum left tilt and to a position of maximum right tilt, and at the position of maximum left tilt each of the first arch-shaped surface, the second arch-shaped surface, and the first connecting member engage the ground to prevent further tilting.

8. A support assembly for connection to a stationary bicycle having a front cross member and a rear cross member, the support assembly comprising:

a first rocker unit configured to operably connect to the front cross member, the first rocker unit defining a first ground-engaging arch-shaped surface;

a second rocker unit configured to operably connect to the rear cross member, the second rocker unit defining a second ground-engaging arch-shaped surface;

a first connecting member extending from the first rocker unit to the second rocker unit;

a second connecting member extending from the first rocker unit to the second rocker unit; and a stabilizing step rotatably mounted on the first connecting member.

9. The support assembly as claimed in claim 8, wherein:

the support assembly, with the stationary bike operably connected thereto, is configured to tilt on the first and second arch-shaped surfaces between a position of maximum left tilt and a position of maximum right tilt, the first rocker unit includes a first stop structure at a first end of the first arch-shaped surface and a second stop structure at a second end of the first arch-shaped surface, the second rocker unit includes a third stop structure at a first end of the second arch-shaped surface and a fourth stop structure at a second end of the second arch-shaped surface, and at the position of maximum left tilt, each of the first arch-shaped surface, the second arch-shaped surface, the first stop structure, the third stop structure, and the stabilizing step engage the ground.

10. The support assembly as claimed in claim 9, wherein at the position of maximum left tilt, the first connecting member and the second connecting member are spaced apart from the ground.

11. The support assembly as claimed in claim 8, wherein the first rocker unit comprises:

a first support wall;

a second support wall spaced apart from the first support wall; and a support block positioned between the first and second support walls, the support block defining a support surface, wherein the front cross member is positioned on the support surface and between the first and second support walls when the front cross member is operably connected to the first rocker unit.

12. The support assembly as claimed in claim 8, wherein:

the stationary bicycle defines a longitudinal axis, and when the stationary bicycle is operably connected to the first rocker unit and the second rocker unit, the first connecting member is located on a first side of the longitudinal axis and the second connecting member is located on an opposite second side of the longitudinal axis.

13. The support assembly as claimed in claim 8, further comprising:

a first elastomeric strip mounted on the first arch-shaped surface, a second elastomeric strip mounted on the second arch-shaped surface, and an elastomeric portion mounted on the stabilizing step.

14. A support assembly for connection to a stationary bicycle having a front cross member and a rear cross member, the support assembly comprising:

a first rocker unit configured to operably connect to the front cross member, the first rocker unit defining a first arch-shaped surface located between a first stop structure and a second stop structure;

a second rocker unit configured to operably connect to the rear cross member, the second rocker unit defining a second arch-shaped surface located between a third stop structure and a fourth stop structure;

a first connecting member extending from the first stop structure to the third stop structure; and a second connecting member extending from the second stop structure to the fourth stop structure, wherein the support assembly is configured to tilt on the first and second arch-shaped surfaces between a position of maximum left tilt and a position of maximum right tilt, wherein at the position of maximum left tilt, the first stop structure and the third stop structure engage the ground to prevent further left tilting, and wherein at the position of maximum right tilt, the second stop structure and the fourth stop structure engage the ground to prevent further right tilting.

15. The support assembly as claimed in claim 14, further comprising:

a first stabilizing step mounted on the first connecting member and defining a first stop surface;

a second stabilizing step mounted on the second connecting member and defining a second stop surface, wherein at the position of maximum left tilt, the first stop structure, the third stop structure, and the first stop surface engage the ground to prevent further left tilting, and wherein at the position of maximum right tilt, the second stop structure, the fourth stop structure, and the second stop surface engage the ground to prevent further right tilting.

16. The support assembly as claimed in claim 15, wherein:

the first stabilizing step is rotatably mounted on the first connecting member, and the second stabilizing step is rotatably mounted on the second connecting member.

17. The support assembly as claimed in claim 14, wherein:

at the position of maximum left tilt, the first stop structure, the third stop structure, and the first connecting member engage the ground to prevent further left tilting, and at the position of maximum right tilt, the second stop structure, the fourth stop structure, and the second connecting member engage the ground to prevent further right tilting.

* * * * *